US005863872A

United States Patent [19]

Garmier

[11] Patent Number: 5,863,872

[45] **Date of Patent: *Jan. 26, 1999**

[54] BIODEGRADABLE LUBRICANT COMPOSITION FROM TRIGLYCERIDES AND OIL SOLUBLE COPPER

[75] Inventor: William W. Garmier, Hartville, Ohio

[73] Assignee: Renewable Lubricants, Inc., Hartville, Ohio

[ * ] Notice: The term of this patent shall not extend beyond the expiration date of Pat. No. 5,736,493.

[21] Appl. No.: 918,076

[22] Filed: Aug. 25, 1997

Related U.S. Application Data

[63] Continuation of Ser. No. 644,964, May 15, 1996, Pat. No. 5,736,493.

[51] Int. Cl.[6] ..... C10M 105/38

[52] U.S. Cl. ..... 508/491; 508/150; 508/365; 508/371; 508/382

[58] Field of Search ..... 508/491

[56] References Cited

U.S. PATENT DOCUMENTS

| | | | |
|---|---|---|---|
| 2,716,089 | 8/1955 | Cyphers et al. | 508/363 |
| 3,702,301 | 11/1972 | Baldwin | 508/488 |
| 4,741,845 | 5/1988 | King | 508/141 |
| 4,766,228 | 8/1988 | Born et al. | 508/371 |
| 4,783,274 | 11/1988 | Jokinen et al. | 508/209 |
| 4,867,890 | 9/1989 | Colclough et al. | 508/192 |
| 5,034,144 | 7/1991 | Ohgate et al. | 508/488 |
| 5,089,157 | 2/1992 | Trivett | 508/284 |
| 5,298,177 | 3/1994 | Stoffa | 508/231 |
| 5,338,471 | 8/1994 | Lal | 508/491 |
| 5,399,275 | 3/1995 | Lange et al. | 508/470 |
| 5,413,725 | 5/1995 | Lal et al. | 508/491 |
| 5,427,700 | 6/1995 | Stoffa | 508/491 |
| 5,427,704 | 6/1995 | Lawate | 508/491 |
| 5,520,830 | 5/1996 | Klaus et al. | 508/150 |
| 5,736,493 | 4/1998 | Garmier | 508/491 |

FOREIGN PATENT DOCUMENTS

| | | |
|---|---|---|
| 0 294 045 A | 12/1988 | European Pat. Off. . |
| 0 301 727 A | 2/1989 | European Pat. Off. . |
| 0 604 125 A | 6/1994 | European Pat. Off. . |
| 2 134 923 | 8/1984 | United Kingdom . |

OTHER PUBLICATIONS

European Search Report published with PCT/US97/08384, completed Sep. 5, 1997, PCT.

*Primary Examiner*—Ellen M. McAvoy
*Attorney, Agent, or Firm*—Hudak & Shunk Co., L.P.A.

[57] ABSTRACT

A lubricant composition is disclosed which comprises, a triglyceride oil lubricant and an oil soluble copper compound antioxidant. The oil soluble copper compounds are particularly effective antioxidants for triglycerides. The lubricant composition can include soluble zinc compounds which reduce wear and/or soluble antimony compounds which reduce wear and can function as adjuvant antioxidants reducing the amount of oil soluble copper required. Preferred zinc and antimony compounds are zinc dithiophosphate antiwear/antioxidant, and antimony dialkyldithiocarbamate antioxidant adjuvant.

24 Claims, 1 Drawing Sheet

BIODEGRADABLE LUBRICANT COMPOSITION FROM TRIGLYCERIDES AND OIL SOLUBLE COPPER

CROSS-REFERENCE

This is a continuation of application Ser. No. 08/644,964, filed May 15, 1996, now U.S. Pat. No. 5,736,493, of William W. Garmier, for BIODEGRADABLE LUBRICANT COMPOSITION FROM TRIGLYCERIDES AND OIL SOLUBLE COPPER.

This invention was made with government support under Contract No. 93-COOP-1-9542 awarded by the U.S. Department of Agriculture and funded by the U.S. Department of Defense. The government has certain rights in the invention.

FIELD OF THE INVENTION

The present invention relates to a biodegradable lubricant compositions made from vegetable oil triglycerides and oil soluble copper compounds. The lubricant compositions can be used for lubricating engines, transmissions, gear boxes, and for hydraulic applications. Specified optional oil soluble antimony compounds can reduce the amount of copper required to impart oxidation resistance.

BACKGROUND

Vegetable oil triglycerides have been available for use in food products and cooking. Many such vegetable oils contain natural antioxidants such as phospholipids and sterols that prevent oxidation during storage. Triglycerides are considered the esterification product of glycerol with 3 molecules of carboxylic acids. The amount of unsaturation in the carboxylic affects the susceptibility of the triglyceride to oxidation. Oxidation can include reactions that link two or more triglycerides together through reactions of atoms near the unsaturation. These reactions can form higher molecular weight material which can become insoluble and discolored e.g. sludge. Oxidation can also result in cleavage of the ester linkage or other internal cleavage of the triglycerides. The fragments of the triglyceride from the cleavage, being lower in molecular weight, are more volatile. Carboxylic acid groups generated from the triglyceride make the lubricant acidic. Aldehyde groups can also be generated. Carboxylic acid groups have attraction for oxidized metals and can solubilize them in oil promoting metal removal from some surfaces.

Due to oxidation problems with triglycerides most commercial lubricants are formulated from petroleum distillates which have lower amounts of unsaturation making them resistant to oxidation. Petroleum distillates require additives to reduce wear, reduce oxidation, lower the pour point and modify the viscosity index (to adjust either the high or low temperature viscosity) etc. The petroleum distillates are resistant to biodegradation and the additives used to adjust their characteristics (often containing metals and reactive compounds) further detract from the biodegradability of the used lubricant.

Synthetic ester lubricants having little or no unsaturation in the carbon to carbon bonds are used in premium quality motor oils due to their desirable properties. However the acids and alcohols used to make synthetic ester usually are derived from petroleum distillates and are thus not from a renewable source. They are also more costly and less biodegradable than natural triglycerides.

U.S. Pat. No. 4,867,890 discloses the use of soluble copper compounds to prevent oxidation in mineral oil lubricants with an ashless dispersant and zinc dihydrocarbyldithiophosphate. Therein effective amounts of copper were described as from about 5 to about 500 parts per million.

SUMMARY OF THE INVENTION

The use of vegetable oil triglycerides in lubricating oils have been limited due to their susceptibility to oxidative degradation. Oil soluble copper compounds are identified which impart oxidation resistance to vegetable oil triglycerides making the triglycerides suitable for use in a variety of lubricating compositions including demanding higher temperature uses like motor oil. Oils from triglycerides formed from high percentages of oleic acid tend to be better stabilized by the oil soluble copper. A synergism between oil soluble copper compounds and oil soluble antimony compounds results in effective antioxidant protection at lower soluble copper contents.

DETAILED DESCRIPTION OF THE INVENTION

Figure 1:
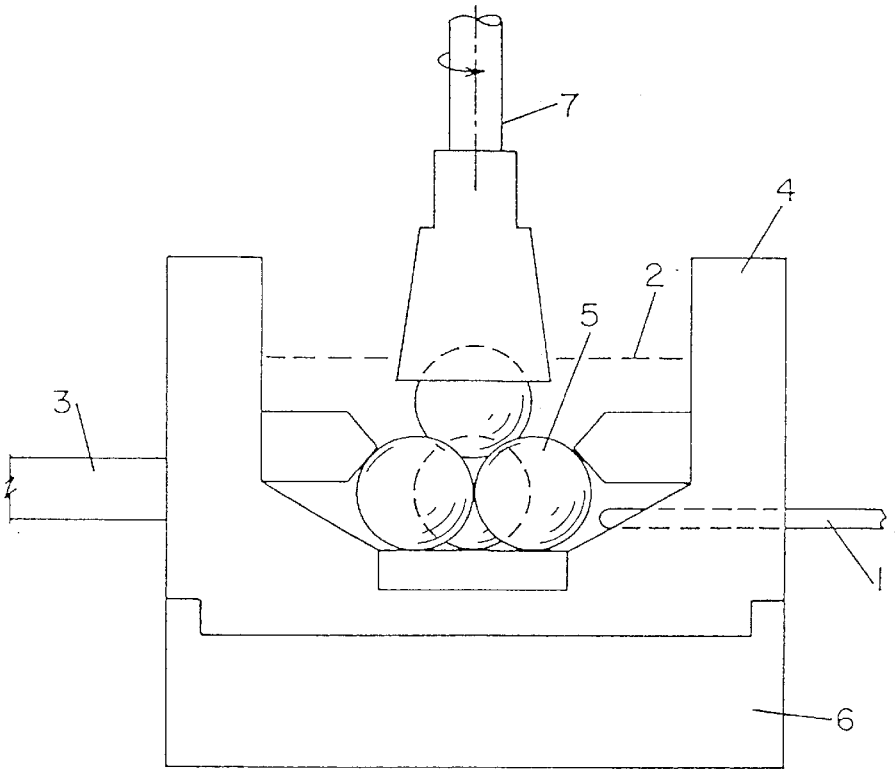
FIG. 1 illustrates a four ball wear tester wherein 1 is a thermocouple, 2 is the lubricant level, 3 is a side arm which holds the ball pot (4), 5 is the steel ball bearings, 6 is a heating block and 7 is a shaft which supplies a force to rotate the uppermost ball.

The triglycerides stabilized by copper in this invention are one or more triglycerides of the formula

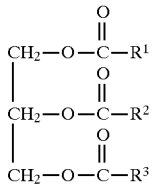

wherein $R^1$, $R^2$ and $R^3$ are aliphatic hydrocarbyl groups containing from about 7 to about 23 carbon atoms wherein at least about 20, 30, 40, 50, or 60 percent of the R groups of the triglycerides are monounsaturated and further desirably wherein from about 2 up to about 90 mole percent of the $R^1$, $R^2$, and $R^3$ groups, based upon the total number of all such groups of the triglyceride, are the aliphatic portion of oleic acid. These triglycerides are available from a variety of plants or their seeds and are commonly referred to as vegetable oils.

The term "hydrocarbyl group" as used herein denotes a radical having a carbon atom directly attached to the remainder of the molecule. The aliphatic hydrocarbyl groups include the following:

(1) Aliphatic hydrocarbon groups are preferred; that is, alkyl groups such as heptyl, nonyl, undecyl, tridecyl, heptadecyl; alkenyl groups containing a single double bond such as heptenyl, nonenyl, undecyl, tridecyl, heptadecyl, heneicosenyl; alkenyl groups containing 2 or 3 double bonds such as 8,11-heptadecadienyl and 8,11,14-heptadecadienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, but contain atoms other than carbon present in a chain or ring otherwise composed of aliphatic carbon atoms. Suitable hetero atoms will be apparent to those skilled in the art and include, for example, oxygen, nitrogen and sulfur.

Generally, the fatty acid moieties (hydrocarbyl group $R^1$, $R^2$ or $R^3$ plus a carboxyl group) are such that the $R^1$, $R^2$, and $R^3$ groups of the triglyceride are at least 30, 40, 50, or 60 percent, preferably at least 70 percent and most preferably at least 80 mole percent monounsaturated. Normal sunflower oil has an oleic acid content of 25–40 percent. By genetically modifying the seeds of sunflowers, a sunflower oil can be obtained wherein the oleic content is from about 60 up to about 90 mole percent of the acids of the triglyceride. U.S. Pat. Nos. 4,627,192 and 4,743,402 are herein incorporated by reference for their disclosures directed to the preparation of high oleic sunflower oil. Oils from genetically modified plants are preferred for applications where the use temperature exceeds 100° C., 250° C. or 175° C., such as internal combustion engines. For example, a triglyceride comprised exclusively of an oleic acid moieties has an oleic acid content of 100% and consequently a monounsaturated content of 100%. A triglyceride made up of acid moieties that are 70% oleic acid (monounsaturated), 10% stearic acid (saturated), 5% palmitic acid (saturated), 7% linoleic (di-unsaturated), and 8% hexadecanoic acid (monounsaturated) has a monounsaturated content of 78%.

Triglycerides having enhanced utility in this invention are exemplified by vegetable oils that are genetically modified such that they contain a higher than normal oleic acid content. That is a high proportion of the $R^1$, $R^2$ and $R^3$ groups are heptadecyl groups and a high proportion of the $R^1COO$—, $R^2COO$— and $R^3COO$— that are attached to the 1,2,3,-propanetriyl groups —$CH_2CHCH_2$— are the residue of an oleic acid molecule. The preferred triglyceride oils are genetically modified high oleic (at least 60 percent) acid triglyceride oils. Typical genetically modified high oleic vegetable oils employed within the instant invention are high oleic safflower oil, high oleic corn oil, high oleic rapeseed oil, high oleic sunflower oil, high oleic soybean oil, high oleic cottonseed oil, high oleic peanut oil, high oleic lesquerella oil, high oleic meadowfoam oil and high oleic palm olein. A preferred high oleic vegetable oil is high oleic sunflower oil obtained from Helianthus sp. This product is available from SVO Enterprises, Eastlake, Ohio as Sunyl® high oleic sunflower oil. Sunyl 80 is a high oleic triglyceride wherein the acid moieties comprise 80 percent oleic acid. Another preferred high oleic vegetable oil is high oleic rapeseed oil obtained from *Brassica campestris* or *Brassica napus,* also available from SVO Enterprises as RSR high oleic rapeseed oil. RS 80 signifies a rapeseed oil wherein the acid moieties comprise 80 percent oleic acid. Also preferred are high oleic corn oil and blends of high oleic sunflower and high oleic corn oils.

It is to be noted the olive oil is included or may be excluded as a vegetable oil in different embodiments of this invention. The oleic acid content of olive oil typically ranges from 65–85 percent. This content, however, is not achieved through genetic modification, but rather is naturally occurring. Castor oil can also be included or excluded as a vegetable oil for this application.

It is further to be noted that genetically modified vegetable oils have high oleic acid contents at the expense of the di- and tri- unsaturated acids, such as linoleic. A normal sunflower oil has from 20–40 percent oleic acid moieties and from 50–70 percent linoleic acid moieties (di-unsaturated). This gives a 90 percent content of mono- and di- unsaturated acid moieties (20+70) or (40+50). Genetically modifying vegetable oils generate a low di- or tri- unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of oleic:linoleic of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

The above described triglycerides have many desirable lubricating properties as compared to commercial mineral oil (hydrocarbon) lubricant basestocks. The fume point of triglycerides is about 200° C. and the flash point about 300° C. (both determinations as per AOCS Ce 9a-48 or ASTM D1310). In a lubricating oil, this results in low organic emissions to the environment and a reduced fire hazard. The flash points of hydrocarbon basic oils are, as a rule, lower. The triglyceride oils are of a polar nature and thus differ from the non-polar hydrocarbons. This accounts for the superb ability of triglycerides to be adsorbed on metal faces as very thin adhering films. The adhering nature of the film assures lubrication while the thin nature allows for parts to be designed with less intervening space for lubricant. A study of the operation of glide faces placed in close relationship to each other, considering pressure and temperature to be the fundamental factors affecting lubrication, shows that the film-formation properties of triglycerides are particularly advantageous in hydraulic systems. In addition, water cannot force an adhering triglyceride oil film off a metal face as easily as a hydrocarbon film.

The structure of the triglyceride molecule is generally more stable against mechanical and heat stresses existing in the hydraulic systems than the linear structure of mineral oils. In addition, the ability of the polar triglyceride molecule to generally adhere onto metallic surfaces improves the lubricating properties of these triglycerides. The only property of the said triglycerides which would impede their intended use for hydraulic purposes is their tendency to be oxidized easily.

The vegetable-based oils have substantial benefits over petroleum-based mineral oils as lubricant base stocks. These benefits include:

1) Renewable—The base stocks are renewable resources from the U.S. agricultural market.

2) Biodegradable—The base fluids are completely biodegradable due to their ability to cleave at the ester linkage and oxidize near the carbon-carbon double bond.

3) Non-toxic—The base fluids are ingestible. This benefit coupled with the biodegradability, means that the fluid are a less significant environmental hazard from uncontrolled spills.

4) Safety—The vegetable oils possess very high flash points, on the average, more than 290° C. (570° F.) reducing the fire hazard from the lubricant.

5) Reduced Engine Emissions—Due to the low volatility and high boiling points of the triglyceride base oils, less lubricant ends up in the exhaust emissions and as particulate material.

6) High Viscosity Index (HVI)—Vegetable oils have desirable temperature-viscosity properties with viscosity indexes (VI's) greater than 200 which results better oil viscosity control at elevated engine temperatures and less need for expensive VI improver additives. A high viscosity index means the oil thins less on heating. Therefore, a lower viscosity oil at room temperature can be used.

7) Improved Fuel Economy—Fuel economy improvements result from reduced friction of triglyceride oils. The HVI's of triglyceride oils allow the use of less viscous base stocks to meet higher temperature requirements in top ring and grove zones of pistons. This reduces fuel consumption.

8) In-situ Lubricating Films—Thermal or oxidative degradation results in fatty acid constituents that can adhere to the surface and improve anti-wear properties.

9) Unique Protection from Contaminants and Corrosion—The chemical fatty acid structures of the high oleic vegetable oils provide unique natural corrosion protection, inherent detergent and solubility properties. Detergent and solubility properties help keep moving parts free of sludge and deposits.

Desirably the above described vegetable oils and/or genetically modified vegetable oils are at least about 20, 30, 40, 50, or 60 volume % of a formulated lubricant composition, more desirably, such as when used as an engine lubricant, from about 40 to about 95 or 99 volume % and preferably from about 50 or 60 to about 90 or 95 volume % of the lubricant.

Other base lubricating fluids such as petroleum distillate products, isomerized or hydrocracked oils such as synthesized from hydrocarbon fractionation, polyalphaolefins (PAOs) or synthetic ester oils may comprise up to 30, 40, 50, 60, or 70 vol %, more desirably from about 1 or 3 to about 25 vol % of the formulated lubricant composition. These may be purposefully added to impart certain properties or may be carriers for other additives used in the lubricant composition. The formulated lubricant composition can also contain up to 20 volume %, more desirably from about 5 to about 15 volume % of commercial additives for lubricants. These include the metal containing antioxidants, antiwear additives, detergents, inhibitors, ashless dispersants, antimony adjuvant antioxidant and pour point depressants, such as copolymers of vinyl acetate with fumaric acid esters of coconut oil alcohols. The lubricant may also contain up to 35 volume % of viscosity index modifiers such as olefin copolymers, polymethacrylates, etc. The lubricating compositions can and usually will contain other traditional lubricant additives such as rust inhibitors such as lecithin, sorbitan mono-oleate, dodecyl succinic anhydride or ethoxylated alkyl phenols.

The copper antioxidant may be blended into the oil as any suitable oil soluble copper compound. By oil soluble we mean the compound is soluble under normal blending conditions in the oil or in an additive package for the lubricant composition. The copper compound may be in the cuprous or cupric form. The copper compound can be copper dihydrocarbyl thio- or dithio-phosphates. Similar thio and dithio phosphates of zinc are well known and the copper thio and dithio phosphate compounds are made by corresponding reactions where one mole of cuprous or cupric oxide may be reacted with one or two moles of the dithiophosphoric acid. Alternatively the copper may be added as the copper salt of a synthetic or natural carboxylic acid. Examples include $C_3$ to $C_{18}$ saturated fatty acids such as stearic or palmitic, but include unsaturated and aromatic acids such as oleic or branched carboxylic acids such as naphthenic acids of molecular weight from 200 to 500. Synthetic carboxylic acids are preferred because of the improved handling and solubility properties of the resulting copper carboxylates. Preferred examples include copper 2-ethylhexanoate, copper neodecanoate, copper stearate, copper propionate, copper naphthalate, and copper oleate or blends thereof.

The copper compound can also be oil soluble copper dithiocarbamates of the general formula $(RR'NCSS)_n$ Cu where n is 1 or 2 and R and R' are the same or different hydrocarbyl radicals containing from 1 to 18 and preferably from 2 to 12 carbon atoms including radicals such as alkyl alkenyl, aralkyl and cycloaliphatic radicals. Preferred are alkyl groups of 2 to 8 carbon atoms. Copper sulphonates, phenates, and acetyl acetonates can also be used. In a preferred embodiment the organic portion of the oil soluble copper compound is free of atoms other than carbon, hydrogen and oxygen.

When used in combination with the zinc dialkyl dithiophosphates the quantity of copper in the oil is important to obtaining the combination of antioxidant and antiwear properties needed for extended life lubricants.

Desirably, the lubricant composition contains from about 50 to about 3000 ppm Cu, more desirably from about 50 or 100 to about 2000 ppm, preferably from about 100 or 150 to about 800 ppm or 1200 ppm and (especially when antimony is present) most preferably from about 100 or 150 to about 500, 600, 700, or 800 ppm based upon the weight of the lubricant composition.

Oil soluble antimony compounds in the lubricant composition can act as an adjuvant antioxidant reducing the amount of oil soluble copper typically used from about 1000 ppm to 2000 ppm in the lubricant to about 500 ppm with the same antioxidant protection. An effective antimony compound is antimony dialkyldithiocarbamate such as Vanlube® 73 from R. T. Vanderbilt having the formula

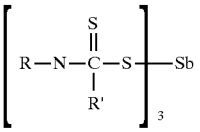

where R and R' are hydrocarbyl radicals as described later with 1 to 18 carbon atoms, more desirably from 2 to 12 carbon atoms. More desirably, the hydrocarbyl radicals are alkyl or alkenyl radicals. Antimony dialkylphosphorodithioates such as Vanlube® 622 or 648 also from R. t. Vanderbilt may be effective. These are similar to the zinc dihydrocarbyldithiophosphates having the formula

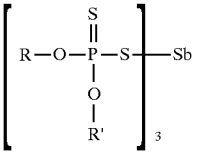

where R and R' can be the same or different hydrocarbyl radicals containing from 1 to 18, preferably from 2 to 12 carbon atoms such as described for the zinc compound. Desirably the hydrocarbyl radicals are alkyl, alkenyl, aryl, aralkyl, alkaryl or cycloaliphatic radicals. Desirably antimony concentrations in the lubricant are from about 100 to about 4000 ppm, more desirably from about 100 to about 2000 ppm, and preferably from about 100 or 200 to about 800 or 1000 ppm antimony based on the lubricant composition. The commercial manufacture of a preferred antimony compound recommends from about 0.1 to about 1 wt. % (600 ppm antimony) and for antiwear and/or extreme pressure uses from 0.1 to about 5 wt. % in lubricant compositions. It has also been discovered that the soluble antimony compounds function as anti-wear agents. This reduces the need for zinc dithio phosphates which contributes to phosphorus poisoning in catalytic converters.

Zinc dihydrocarbyl dithiophosphates anti-wear additives (wear inhibitors) are desirably used in the compositions and can be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols. Secondary alcohols generally impart improved antiwear properties, with primary giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil soluble salts of dihydrocarbyl esters of dithiophosphoric acids and may be represented by the following formula:

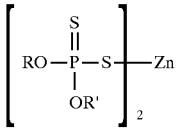

wherein R and R' may be the same or different hydrocarbyl radicals containing from 1 to 18 preferably 2 to 12 carbon atoms and including radicals such as alkyl, alkenyl, aryl, aralkyl, alkaryl and cycloaliphatic a radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, n-heptyl, n-octyl, decyl, dodecyl, octadecyl, 2-ethylhexyl, phenyl, butylphenyl, cyclohexyl, methylcyclopentyl, propenyl, butenyl etc. In order to obtain oil solubility, the total number of carbon atoms (i.e. from R and R') in the dithiophosphoric acid will generally be about 5 or greater. The zinc dithiophosphates are desirably used in amounts that result in from about 100 to about 3000 ppm zinc in the lubricant composition, more desirably from about 500 to about 2500 ppm zinc. The use of oil soluble antimony can reduce the need for oil soluble zinc.

In prior art oils, other antioxidants in addition to the zinc dialkyldithiophosphate are sometimes required to improve the oxidative stability of the oil. These supplementary antioxidants are typically in the oil in amounts from about 0.5 to about 2.5 wt. %. The supplementary antioxidants can be included in this composition and include phenols, hindered-phenols, bis-phenols, and sulphurized phenols, catechol, alkylated catechols and sulphurized alkyl catechols, diphenylamine and alkyl diphenylamines, phenyl-1-naphthylamine and its alkylated derivatives, alkyl borates and aryl borates, alkyl phosphites and alkyl phosphates, aryl phosphites and aryl phosphates, O,O,S-trialkyl dithiophosphates, O,O,S-triaryl dithiophosphates and O,O,S-trisubstituted dithiophosphates optionally containing both alkyl and aryl groups, metal salts of dithioacids, phosphites, sulphides, hydrazides, triazols.

However, the inclusion of small amounts of copper generally removes the need for these supplementary antioxidants. It would be within the scope of the invention that a supplementary antioxidant be included especially for oils operating under conditions where the presence of such supplementary antioxidants may be beneficial.

The use of oil soluble copper permits replacing part or all of the need for supplementary antioxidants. Frequently, it enables lubricating compositions having the desired antioxidant properties to be obtained with either no additional supplementary antioxidant or with less than normal concentrations, for example with less than 0.5 wt. % and frequently less than about 0.3 wt. % of the supplementary antioxidant.

The dispersancy of the lubricant composition can be enhanced by a traditional lubricating oil ashless dispersant compounds such as derivatives of long chain hydrocarbon substituted carboxylic acids in which the hydrocarbon groups contains 50 to 400 carbon atoms. These generally are a nitrogen containing ashless dispersant having a relatively high molecular weight aliphatic hydrocarbon oil solubilizing group attached thereto or an ester of a succinic acid/anhydride with a high molecular weight aliphatic hydrocarbon attached thereto and derived from monohydric and polyhydric alcohols, phenols and naphthols.

The nitrogen containing dispersant additives are those known in the art as sludge dispersants for crank-case motor oils. These dispersants include mineral oil soluble salts, amides, imides, oxazolines and esters of mono- and dicarboxylic acids (and where they exist the corresponding acid anhydrides) of various amines and nitrogen containing materials having amino nitrogen or heterocyclic nitrogen and at least one amido or hydroxy group capable of salt, amide, imide, oxazoline or ester formation. Other nitrogen containing dispersants which may be used in this invention include those wherein a nitrogen containing polyamine is attached directly to the long chain aliphatic hydrocarbon as shown in U.S. Pat. Nos. 3,275,554 and 3,565,804, herein incorporated by reference, where the halogen group on the halogenated hydrocarbon is displaced with various alkylene polyamines. Additional details regarding ashless dispersants are disclosed in U.S. Pat. No. 4,867,890 hereby incorporated by reference.

This invention desirably utilizes a detergent-inhibitor additive that preferably is free from phosphorous and zinc and comprises at least one metal overbased composition and/or at least one carboxylic dispersant composition, diaryl amine, sulfurized composition and metal passivator. The purpose of the detergent-inhibitor additive is to provide cleanliness of mechanical parts, anti-wear, and extreme pressure protection, anti-oxidation performance and corrosion protection.

The metal overbased salts of organic acids are widely known to those of skill in the art and generally include metal salts wherein the amount of metal present in them exceeds the stoichiometric amount. Such salts are said to have conversion levels in excess of 100% (i.e., they comprise more than 100% of the theoretical amount of metal needed to convert the acid to its "normal" "neutral" salt). Such salts are often said to have metal ratios in excess of one (i.e. the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalent of the metal in the salt which would be expected to result in the reaction between the organic acid to be overbased and then basically reacting metal compound according to the known chemical reactivity and stoichiometry of the two reactants. Thus, in a normal or neutral salt the metal ratio is one and in an overbased salt the metal ratio is greater than one.

The overbased salts used usually have metal ratios of at least about 3:1. Typically, they have ratios of at least about 12:1. Usually they have metal ratios not exceeding about 40:1. Typically salts having ratios of about 12:1 to about 20:1 are used.

The basically reacting metal compounds used to make these overbased salts are usually an alkali or alkaline earth metal compound (i.e., the Group IA, IIA, and IIB metals excluding francium and radium and typically excluding rubidium, cesium and beryllium) although other basic reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art incorporated by reference herein. Overbased salts containing a mixture of ions of two or more of these metals can be used in the present invention.

The overbased salts can be of oil-soluble organic sulfur acids such as sulfonic, sulfamic, thiosulfonic, sulfmic, partial ester sulfuric, sulfurous and thiosulfuric acid. Generally they are salts of carbocyclic or aliphatic sulfonic acids. Additional details of various metal overbased salts of organic acids are described in U.S. Pat. No. 5,427,700 which is hereby incorporated by reference.

Metal passivators such as toly-triazole or an oil-soluble derivative of a dimercaptothiadiazole are desirably present in the lubricant composition.

The dimercaptothiadiazoles which can be utilized as a starting material for the preparation of oil-soluble derivatives containing the dimercaptothiadiazole nucleus have the following structural formulae and names:

2,5-dimercapto-1,3,4-thiadiazole

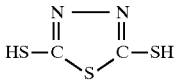

3,5-dimercapto-1,2,4-thiadiazole

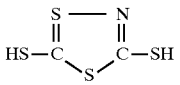

3,4-dimercapto-1,2,5-thiadiazole

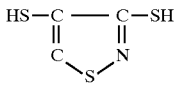

-continued 4,5-dimercapto-1,2,3-thiadiazole

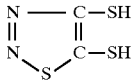

Of these the most readily available, and the one preferred for the purpose of this invention, is 2,5-dimercapto-1,3,4-thiadiazole. This compound will sometimes be referred to hereinafter as DMTD. However, it is to be understood that any of the other dimercapto-thiadiazoles may be substituted for all or a portion of the DMTD.

DMTD is conveniently prepared by the reaction of one mole of hydrazine, or a hydrazine salt, with two moles of a carbon disulfide in an alkaline medium, followed by acidification.

Derivatives of DMTD have been described in the art, and any such compounds can be included. The preparation of some derivatives of DMTD is described in E. K. Fields "Industrial and Engineering Chemistry", 49, p. 1361–4 (September 1957). For the preparation of the oil-soluble derivatives of DMTD, it is possible to utilize already prepared DMTD or to prepare the DMTD in situ and subsequently add the material to be reacted with DMTD. Additional details on various metal passivators and their preparation are described in U.S. Pat. No. 5,427,700 which is hereby incorporated by reference.

This invention also optionally utilizes viscosity modifying compositions including viscosity index modifiers to provide sufficient viscosity at higher temperatures. The modifying compositions, include a nitrogen-containing ester of a carboxy-containing interpolymer, said interpolymer having a reduced specific viscosity of from about 0.05 to about 2, said ester being substantially free of tiltratable acidity and being characterized by the presence within its polymeric structure of at least one of each of three pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonylpolyamino group derived from a polyamine compound having one primary or secondary amino group, wherein the molar ratio of (A):(B):(C) is (60–90):(10–30):(2–15)

An essential element of a preferred viscosity modifying additive is that the ester is a mixed ester, i.e, one in which there is the combined presence of both a high molecular weight ester group and a low molecular weight ester group, particularly in the ratio as stated above. Such combined presence is critical to the viscosity properties of the mixed ester, both from the standpoint of its viscosity modifying characteristics and from the standpoint of its thickening effect upon lubricating compositions in which it is used as an additive.

In reference to the size of the ester groups, it is pointed out that an ester radical is represented by the formula

—C(O) (OR)

and that the number of carbon atoms in an ester radical is the combined total of the carbon atoms of the carbonyl group and the carbon atoms of the ester group i.e., the (OR) group. Additional details of the viscosity modifying additives are in U.S. Pat. No. 5,427,700 hereby incorporated by reference.

The lubricant composition can comprise a synthetic ester base oil. The synthetic ester base oil comprises the reaction of a monocarboxylic acid of the formula $$R^{16}—COOH$$

or a di or polycarboxylic acid such as the dicarboxylic of the formula $$\begin{array}{l} R^{17}—CHCOOH \\ \quad\quad\;\; | \\ \quad\quad (CH_2)_n \\ \quad\quad\;\; | \\ \quad\quad CH_2COOH \end{array}$$

with an alcohol of the formula $$R^{18}\,(OH)_m$$

wherein $R^{16}$ is a hydrocarbyl group containing from about 5 to about 12 carbon atoms, $R^{17}$ is hydrogen or a hydrocarbyl group containing from about 4 to about 50 carbon atoms, $R^{18}$ is a hydrocarbyl group containing from 1 to about 18 carbon atoms, m is an integer of from 0 to about 6 and n is an integer of from 1 to about 6.

Useful monocarboxylic acids are the isomeric carboxylic acids of pentanoic, hexanoic, octanoic, nonanoic, decanoic, undecanoic and dodecanoic acids. when $R^{17}$ is hydrogen. Useful dicarboxylic acids are succinic acid, maleic acid, azelaic acid, suberic acid, sebacic acid, fumaric acid and adipic acid. When $R^{17}$ is a hydrocarbyl group containing from 4 to about 50 carbon atoms, the useful dicarboxylic acids are alkyl succinic acids and alkenyl succinic acids. Alcohols that may be employed are methyl alcohol, ethyl alcohol, butyl alcohol, the isomeric pentyl alcohols, the isomeric hexyl alcohols, dodecyl alcohol, 2-ethylhexyl alcohol, ethylene alcohol, diethylene glycol, propylene glycol, neopentyl glycol, pentaerythritol, dipentaerythritol, etc. Specific examples of these esters include dibutyl adipate, di (2-ethylhexyl) sebacate, di-n-hexyl fumarate, dioctyl sebacate, diisooctyl azelate, diisodecyl azelate, dioctylphthalate, didecyl phthalate, dieicosyl sebacate, the 2-ethylhexyl diester of linoleic acid dimer, the complex ester formed by reacting one mole of sebacic acid with two moles tetraethylene glycol and two moles of 2-ethylhexanoic acid, the ester formed by reacting one mole of adipic acid with 2 moles of a 9 carbon alcohol derived from the oxo process of a 1-butene dimer and the like.

EXAMPLES

An accelerated oxidation stability micro reactor was developed by the Chemical Engineering Department Tribology Group of the Pennsylvania State University to test the volatility and oxidative stability of oils. The test uses a metal block with a cavity of depth 0.95±0.35 mm where the oil sample is tested. It is very similar to a constant temperature thermogravimetric analysis except the amount of insoluble sludge (deposit) is separately determined. The apparatus is further described in an article by J. M. Perez et al. "Diesel Deposit Forming Tendencies-Microanalysis Methods" SAE paper No. 910750 (1991). In general, a 30 minute test at 225° C. is equivalent to about 3000–6000 miles of use in a vehicle engine and a 60 minute test would be equivalent to about 12,000 miles (6,000–20,000) depending upon the engine design and load factors in the application. Any liquid in the specimen can be evaluated by gel permeation chromatography to obtain information on changes in the molecular weight distribution of the liquid as a function of test conditions. Low molecular weight products contribute to evaporation loses and higher molecular weight products may eventually form deposits.

Table 1 shows the accelerated oxidation stability tests on 10 vegetable oils. The crambe oil evidently has some natural antioxidant(s). The generally high amounts of deposit formed in the 30 minute tests indicate the oils are unacceptable for engine oil base stock without further modification.

Table 2 shows the effect of a copper additive on the accelerated oxidative stability test of natural oils. The test times were extended from the 30 minutes as shown in Table 1 to periods of time from 1 to 3 hours indicating significant oxidation resistance was imparted by the oil soluble copper compound. The amount of copper is given in ppm Cu which indicates the amount of copper associated with the oil soluble copper compound. All the results were acceptable for 1 hour tests indicating the stabilized lubricant compositions have acceptable oxidation resistance for vehicle engine use (about 12,000 mile equivalent). The high oleic acid content vegetable oils (sunflower, rapeseed, soybean, high oleic corn, and corn) gave superior oxidation resistance with copper than the castor oil (having high percentage or ricinoleic acid, a monounsaturated hydroxy acid). This indicates some synergy between the soluble copper compounds and triglycerides of aliphatic or olefinic carboxylic acids especially from oleic acid. Note that in Table 1 the castor oil without added antioxidants had superior oxidation resistance than all the high oleic oils other than crambe. Table 2 illustrates that vegetable oil with 2000 ppm of the soluble copper compounds have sufficient oxidation stability for use in vehicle engines.

Table 3 illustrates that the soluble copper compound provides superior stability to oxidation than conventional stabilizer packages (used in mineral oil as commercial additives for oxidation, antiwear, dispersants etc.) labeled engine oil package (Eng Pack) and an SG service grade additive package (SG Pack). Also included in this table are a proprietary chlorine containing additive (Cl additive), a Ketjen lube polymer from AKZO Chemical Corp., and K-2300 another commercial lubricant oil additive. The Eng. Pack, SG Pack, Cl containing additive and Ketjen Lube additives had marginal performance as antioxidants at 30 min and unacceptable at 60 min. The oil soluble copper provided superior results at 30 and 60 minutes irrespective of whether used alone or in combination with other additives. The 5 vol. % K-2300 seems to detract from oxidative stability. The zinc dithiophosphate (ZDP), which in mineral oil acts as an antioxidant/antiwear additive, provides some antioxidant protection with high oleic sunflower oil with or without Cl additive and/or Ketjen lube. However the ZDP detracts slightly from oxidative stability when used with copper. As seen in the last four oils examples of the table the proprietary Cl containing additive detracts from oxidative stability when used with the SG Pack either with or without copper even though it provided some oxidative stability without these components as seen in examples 4–8. This illustrates the complexity of formulating a lubricating composition.

Table 4 illustrates accelerated oxidation stability tests on copper free vegetable oils stabilized with conventional antioxidants and mineral oil based motor oils (10W30 and 10W40) . Included is a used 10W-30 vegetable oil lubricant actually used for 2400 miles in a V6 1986 Oldsmobile automobile. That composition was included to illustrate that the formulated oil would work in an automobile engine and would have residual oxidative stability subsequent to said use. The use of oil soluble copper in later lubricant oil formulations provides addition oxidative stability beyond that demonstrated here. The data on mineral oil based motor oils are provided as comparison values of what has been commercially feasible and acceptable in oxidative stability. The comparison in the first two examples using a non-copper antioxidant illustrate that an air environment causes more undesirable deposits than a nitrogen environment. The third example shows the non-copper antioxidant results in excessive deposits in 60 minutes. The multi-weight mineral oils (10W30 and 10W40) illustrate that 10W30 suffers from excessive evaporation while 10W40 suffers from deposit formation. The vegetable oils in later tables stabilized with oil soluble copper have desirable low deposits and low evaporation as compared to these commercial mineral oil compositions.

Table 5 illustrates the oxidation stability of oil compositions stabilized with oil soluble copper containing antioxidants. The first 5 examples illustrate that the stabilizing effect of 2000 ppm copper is diminished only after 3 hours (e.g. at about 180–210 min) in the acceleration oxidation test. The oil soluble copper has been observed to increase the wear (reduced antiwear properties) of the sunflower oil so the next 5 examples illustrate a more wear resistant oil composition with 1 volume % zinc dithiophosphate (ZDP). The examples of crambe, sunflower and corn oils with copper show that higher oleic acid content vegetable oils (crambe and sunflower) are better stabilized against oxidation than regular corn oil. Four sunflower specimens with 2000, 1500, 1000, and 200 ppm copper illustrate that 1000 to 2000 ppm copper is desirable for good oxidative stability in a 60 minute test.

In Table 5 the compositions with copper and antimony have generally equivalent oxidative stability to specimen with copper alone. These compositions with copper and antimony can function with only 500–600 ppm of copper and 500–600 ppm antimony and exhibit equivalent oxidative stability to compositions with 2000 ppm copper. Thus the antimony allows the copper to be effective at lower concentration. The total ppm of metals can thus be decreased. The antimony was added as antimony dialkyldithiocarbamate. The use of the antimony adjuvant antioxidant avoids problems with dispersing 2000 ppm of oil soluble copper and minimizes the deleterious wear increasing effect of soluble copper on the oil.

Table 6 illustrates that many conventional antioxidants do not impart oxidative stability even at 175° C. (i.e. 50° C. lower than previous tests). The tests in Table 6 were conducted at 175° C. since most of the antioxidants are very volatile at 225° C. and were generally known to be less effective than soluble copper. These antioxidants would be appropriate for some of the low temperature hydraulic fluid applications.

Figure 2:
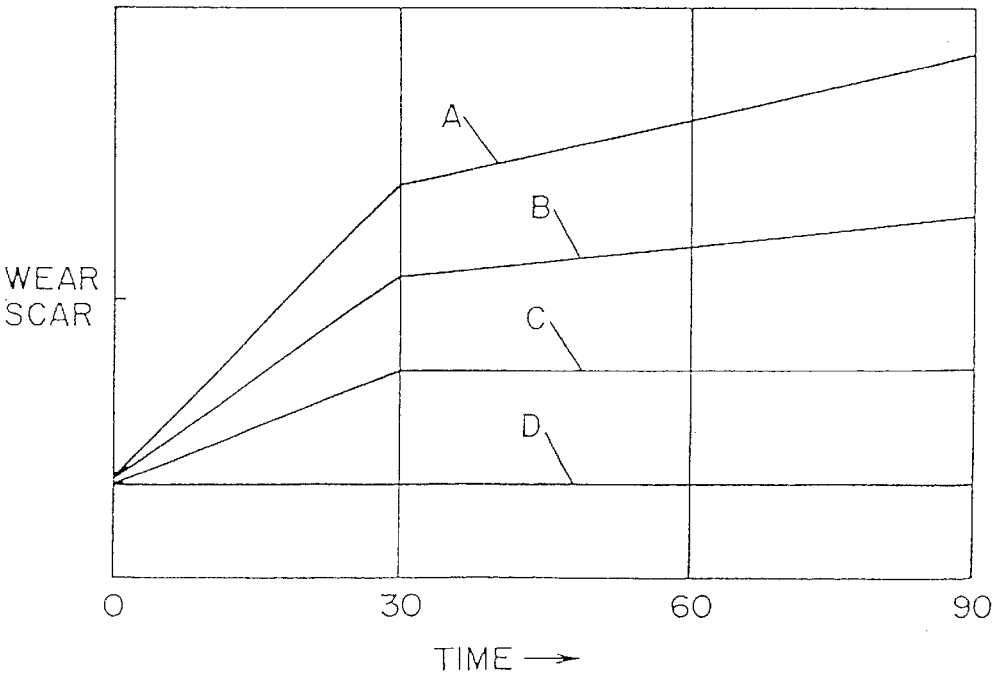
FIG. 2 illustrates the wear on the balls in the sequential four ball wear test. Curve A is typical of mineral oil with additives, curve B is typical of mineral oil and an extreme pressure additive, curve C is characteristic of a lubricant with a good antiwear additive, and line D is the Hertz elastic deformation line.

The Chemical Engineering Department Tribology Group of the Pennsylvania State University also conducted a four-ball wear test as shown in FIG. 1. Therein the balls (5) are 1.27 cm diameter 52–100 steel ball bearings, the side arm (3) holds the ball pot (4) stationary, (3) is the lubricant level in the ball pot (4), the bottom three balls are stationary, the thermocouple (1) measures the temperature, the heating block (6) controls the temperature, and the uppermost ball rotates by a force supplied by shaft (7). The test method includes a standard test method and sequential test method. The sequential test method was supplemented by a modified scuffing test which determined the load required to cause scuffing with the particular lubricant. The wear on the balls characteristic of lubricants in the sequential test are shown in FIG. 2. Typical mineral oil wear with additives is described by the top curve label A. The addition of an extreme pressure additive to the mineral oil results in a curve similar to the one labeled B. A good antiwear additive can result in a curve similar to C where there is little or no increase in wear (wear scar) after the run in (30 minutes in this example) . The bottom line D is the Hertz elastic deformation line that represents the contact area formed by elastic deformation of the balls due to the contact pressure before the test run begins. The delta wear value in Table 7 represents the difference in wear scars before and after each segment of the three sequential test.

Table 7 illustrates the wear properties of vegetable oils and mineral oil with different additives. Comparing lubricants 1 and 2 it is obvious that vegetable oil inherently has better wear resistance both during run-in and during the steady state I and II periods. Comparing lubricant 1 with 2 and 3 illustrates that the oil soluble copper detracts from the inherent wear resistance of vegetable oil. Lubricant 5 from sunflower oil with 1 vol. % zinc dithiophosphate (ZDP) illustrates that only a little zinc dithiophosphae (ZDP) is needed to give sunflower oil equivalent or better wear resistance than a SAE 10W30 mineral oil (lubricant 11). Lubricants 6 and 7 illustrate that 1 volume % ZDP provides good wear resistance (as good as SAE 10W30 lubricant 11). Lubricants 8 and 9 illustrate that LB-400 extreme wear additive is not as effective in providing wear resistance as ZDP, and that the amounts of LB-400 changes its effectiveness. LB-400 is a phosphate ester available from Rhone-Poulonc as an antiwear additive. Lubricant 10 illustrates that an oxidation resistant oil soluble copper containing vegetable lubricant with an effective amount of an antiwear additive can perform similarly to or better than a mineral oil product both with respect to run in and wear.

As shown in the accelerated oxidation tests zinc dithiophosphate (ZDP) detracts form the oxidation resistance of vegetable oils stabilized with oil soluble copper. As shown above oil soluble copper increases wear while ZDP decreases wear (provides antiwear protection). Combination of soluble copper and ZDP offer viable packages for low wear and low oxidation. As previously set forth antimony compounds can also be used as an adjuvant antioxidant with copper and zinc compounds. The oil soluble antimony can replace some or all of the oil soluble zinc, e.g., (ZDP).

In many transportation applications, e.g, piston ring and liner, transmission, gear boxes, hydraulic pumps; the lubricants are required to have, in addition to good friction reduction and wear properties, extreme pressure (extreme temperature) properties to prevent scuffing, galling, and catastrophic wear failures. The friction and wear studies described earlier can be supplemented by a scuffing evaluation test by increasing the load until scuffing occurs. Commercial mineral based engine oils typically have a scuffing load of 80 kgf or less. The vegetable oil compositions can be formulated to have scuffing loads in excess of 100 kgf. The oil soluble copper does reduce scuffing load. The fatty acids from vegetable oils do not increase scuffing load but do reduce friction.

Table 8 illustrates that the vegetable oils inherently have as much or more scuffing resistance than mineral base stocks (petroleum distillates). The scuffing load is the load in kg in the four ball wear tester (shown in FIG. 1) required to cause scuffing (defined as the delta (A) wear exceeding 20 mm). This test is conducted by increasing the load in the four ball wear tester until scuffing occurs. The test evaluates how well the lubricant composition can protect metal parts when high pressure forces the lubricant film to be thinner and thinner. This property is important in piston rings and liners, transmissions, gear boxes, and hydraulic pumps. In a scuffing resistance test one plots wear versus load and generally three linear regions are seen. In the first region wear increases linearly as the load increases. The lubricant and additives are controlling wear. At a determinable load, the lubricant and additives lose control of wear and wear increases at a faster rate developing a wear scar which becomes large enough to support the load. Thereafter, wear continues at an intermediate rate between the first two rates until failure of the parts occurs.

Table 9 illustrates viscosity and metals content of two different vegetable oil engine lubricants and one mineral oil (petroleum distillate) commercial 10W-30.

TABLE 1

Accelerated Oxidation Stability Tests of Natural Oils (40 uL Oxidation Tests) TEMPERATURE 225° C. Microoxidation on low carbon steel, 40 uL sample, open system 30 min.

| Sample | deposit (wt %) | liquid (wt %) | evaporation (wt %) |
|---|---|---|---|
| Sunflower Oil | 63 | 24 | 13 |
| High Oleic Sunflower Oil | 52 | 33 | 15 |
| Castor Bean Oil | 45 | 48 | 7 |
| High Oleic Rapeseed Oil | 55 | 31 | 14 |
| Salad Soybean Oil | 68 | 23 | 9 |
| Soybean Oil | 67 | 24 | 9 |
| High Oleic Corn Oil | 58 | 30 | 12 |
| Corn Oil | 59 | 31 | 10 |
| Crambe Oil | 1o | 83 | 7 |
| Lesquerella Oil | 63 | 30 | 7 |

TABLE 2

Effect of Copper Additive on Accelerated Oxidative Stability Tests of Natural Oils TEMPERATURE 225° C. Microoxidation on low carbon steel, 40 uL sample, open system

| | Test duration | | | | | |
|---|---|---|---|---|---|---|
| | 1 hour | | 2 hours | | 3 hours | |
| Sample | dep. wt % | evap. wt % | dep. wt % | evap. wt % | dep. wt % | evap. wt % |
| Sunflower Oil + 2000 ppm Cu | 1 | 3 | 2.5 | 6 | 3.5 | 9 |
| Castor Bean Oil + 2000 ppm Cu | 7 | 1 | 70 | 8 | 80 | 15 |
| High Oleic Rapeseed Oil + 2000 ppm Cu | 1.5 | 1 | 4 | 4 | 36 | 8 |
| Refined Bleached Soybean Oil + 2000 ppm Cu | N/A* | N/A | 37 | 4 | N/A | N/A |
| Salad Soybean Oil + 2000 ppm Cu | N/A | N/A | 60 | 10 | N/A | N/A |
| High Oleic Corn Oil + 2000 ppm Cu | 1 | 2 | 17 | 6 | 37 | 10 |
| Conventional Corn Oil + 2000 ppm Cu | 10 | 4 | 60 | 10 | N/A | N/A |

*N/A means the test results are not available.

TABLE 3

Accelerated Oxidation Stability Test of Sunflower Oil Formulations With Different Additives TEMPERATURE 225° C. Low carbon steel, 40 uL sample, open system

| | 30 min. | | | 60 min. | | |
|---|---|---|---|---|---|---|
| Sample | deposit | liquid | evap. | deposit | liquid | evap. |
| High Oleic Sunflower Oil | 52 | 33 | 15 | N/A | N/A | N/A |
| +11 vol. % Eng. Pack | 6 | 87 | 7 | 10 | 78.5 | 11.5 |
| +11 vol. % SG Pack | 5.5 | 88 | 6.5 | N/A | N/A | N/A |
| High Oleic Sunflower Oil + 1.5 vol. % of a 60% Cl Additive | 8 | 83 | 9 | 47 | 35 | 18 |
| +5 vol. % Ketjen Lube | 6 | 88 | 6 | 22 | 71 | 7 |
| +5 vol. % K-2300 | 20 | 70 | 10 | N/A | N/A | N/A |
| +11 vol. % Eng. Pack | 7 | 89 | 9 | 20 | 69 | 11 |
| +11 vol. % SG Eng. Pack | 7.5 | 83.5 | 9 | 21 | 70 | 9 |
| Sunflower Oil | 63 | 24 | 13 | N/A | N/A | N/A |
| +1 vol. % zinc dithiophosphate (ZDP) oxidation inhibitor | 13 | 77 | 10 | N/A | N/A | N/A |
| +2000 ppm Cu | 0.5 | 99.5 | 0 | 1 | 95 | 4 |
| +2000 ppm Cu + 1% ZPD | 1.5 | 97.5 | 1 | 2.5 | 90 | 7.5 |

| | 60 min. | | | 120 min. | | |
|---|---|---|---|---|---|---|
| Sample | deposit | liquid | evap. | deposit | liquid | evap. |
| High Oleic Sunflower Oil | 63* | 24* | 13* | N/A | N/A | N/A |
| +2000 ppm Cu | 1 | 95 | 4 | 2.5 | 90.5 | 6 |
| +1 vol. % ZDP | 15 | 75 | 10 | N/A | N/A | N/A |
| +2000 ppm Cu + 1 vol. % ZDP | 2.5 | 90 | 7.5 | 11 | 82 | 7 |
| High Oleic Sunflower Oil + 1.5 vol. % Cl Additive | 47 | 35 | 18 | N/A | N/A | N/A |
| +2000 ppm Cu | 1.5 | 97 | 1.5 | 4.5 | 89.5 | 6 |
| +1 vol. % ZDP | 11 | 76 | 13 | N/A | N/A | N/A |
| +2000 ppm Cu + 1 vol. % ZDP | 6 | 86 | 8 | 33 | 52 | 14 |
| High Oleic Sunflower Oil + 1.5 vol. % 60% Cl Additive + 5 vol. % KetjenLube | 22 | 71 | 7 | N/A | N/A | N/A |
| +2000 ppm Cu | N/A | N/A | N/A | 5.5 | 86 | 8.5 |
| +1% ZDP | 6 | 86 | 8 | 37 | 48 | 15 |
| +2000 pm Cu + 1 vol. % ZDP | 3 | 89 | 8 | 34 | 51 | 15 |
| High Oleic Sunflower Oil + 11 vol. % SG Pack with 1.5 vol. % Cl Additive | 10 | 78.5 | 7 | N/A | N/A | N/A |
| +2000 ppm Cu | 20 | 70 | 10 | N/A | N/A | N/A |
| +1.5 vol. % Cl Additive + 2000 ppm Cu | 3.5 | 91 | 5.5 | 10 | 75 | 15 |
| | 6.5 | 82.5 | 11 | 29 | 51 | 20 |

*30 minute test instead of 60 min.

TABLE 4

Accelerated Oxidation Tests on Copper Free Vegetable Oil
Stabilized with Conventional Antioxidants and Mineral Oil Based Motor Oils
TEMPERATURE 225° C.
Low-carbon steel, dry gas flow ≃ 20 $cm^3$/min, 40 $\mu l$ sample

| SAMPLE | TEST CONDITION | WT. % DEPOSIT | LIQUID | EVAPORATION |
|---|---|---|---|---|
| 10W-30 vegetable oil non-copper antioxidant (AO) | 30 min. under nitrogen | 0.2 | 71.3 | 25.2 |
| 10W-30 vegetable Oil non-copper antioxidant | 30 min. under air | 6.4 | 66.5 | 31.5 |
| 10W-30 vegetable Oil non-copper antioxidant | 60 min. under air | 16.9 | 51.9 | 35.2 |
| Used 10W-30 vegetable Oil with non-copper antioxidant | 30 min. air | 8.2 | 79.0 | 17.6 |
| Mineral Oil 10W-30 | 30 min. air | −0.2 | 47.5 | 52.5 |
| Mineral Oil 10W-30 | 60 min. air | 1.5 | 26.6 | 71.9 |
| Mineral Oil 10W-30 | 120 min. air | 8.7 | 6.0 | 85.3 |
| Mineral Oil 10W-40 | 30 min. air | 0.5 | 86 | 13.5 |
| Mineral Oil 10W-40 | 60 min. air | 5.9 | 74.4 | 19.7 |
| Mineral Oil 10W-40 | 120 min. air | 17.0 | 50.9 | 32.1 |

TABLE 5

Accelerated Oxidation Stability Tests on Vegetable Oils Stabilized with Copper
TEMPERATURE 225° C.

| SAMPLE | TEXT CCNDITION | WT. % DEPOSIT | LIQUID | EVAPORATION |
|---|---|---|---|---|
| Sunflower Oil + 2000 ppm copper | 60 min. air | 0.7 (0.7) | 102.8 (95.7) | 3.9 (3.6) |
| Sunflower Oil + 2000 ppm copper | 120 min. air | 2.6 (2.5) | 97.1 (91.9) | 6 (5.7) |
| Sunflower Oil + 2000 ppm copper | 180 min. air | 3.4 (3.1) | 98 (89.1) | 8.6 (7.8) |
| Sunflower Oil + 2000 ppm copper | 210 min. air | 52.3 (49.2) | 43.4 (40.8) | 10.7 (10.1) |
| Sunflower Oil + 2000 ppm copper | 360 min. air | 55.5 (56.3) | 19.2 (19.5) | 23.9 (24.2) |
| Sunflower Oil + 2000 ppm Cu + 1 vol. % ZDP | 30 min. air | 1.5 (1.4) | 104 (97.7) | 1 (0.9) |
| Sunflower Oil + 2009 ppm Cu + 1 vol. % ZDP | 60 min. air | 2.6 (2.5) | 92.5 (89.7) | 8 (7.8) |
| Sunflower Oil + 2000 ppm Cu + 1 vol. % ZDP | 120 min. air | 11.2 (12.4) | 72 (80.0) | 6.8 (7.6) |
| Sunflower Oil + 2000 ppm Cu + 1 vol. % ZDP | 180 min. air | 27.9 (26.6) | 61.5 (58.6) | 15.6 (14.9) |
| Sunflower Oil + 2000 ppm Cu + 1 vol. % ZDP | 210 min. air | 56.3 (56.9) | 25.2 (25.5) | 17.5 (17.7) |
| Crambe + Cu | 60 min. air | 5.1 | 70 | 24.9 |
| Sunflower + Cu | 60 min. air | 5.5 | 67 | 27.5 |
| Corn + Cu | 60 min. air | 14 | 53 | 33 |
| Sunflower Oil + 2000 ppm Cu | 60 min. air | 1 | 99 | 0 |
| Sunflower Oil + 1500 ppm Cu | 60 min. air | 1.4 | 98 | 0.6 |
| Sunflower Oil + 1000 ppm Cu | 60 min. air | 2 | 94.2 | 3.8 |
| Sunflower Oil + 200 ppm Cu | 30 min. air | 14 | 77 | 9 |
| Corn + 50% Sunflower + 550 ppm Cu + 600 ppm Sb | 60 min. air | 2.6 | 72 | 25.4 |
| High Oleic Sunflower Oil + 550 ppm Cu + 600 ppm Sb | 60 min. air | 1.4 | 72 | 26.6 |
| High Oleic Sunflower Oil + Cu | 60 min. air | 3.2 | 70 | 26.8 |

*Numbers in parenthesis are corrected to 100%.

TABLE 6

Accelerated Oxidation Tests on Copper Free Vegetable Oil Stabilized with Conventional Antioxidants
TEMPERATURE 175° C.
Low Carbon Steel, 60 min. with dry air 20 $cm^3$/min., 40 $\mu$l sample

| SAMPLE | WT. % DEPOSIT | LIQUID | EVAPORATION |
|---|---|---|---|
| Vegetable Oil with 1 wt. % biphenol | 2 | 95 | 2 |
| Vegetable Oil with 1 wt. % monophenol | 2 | 95 | 3 |
| Vegetable Oil with 1 wt. % thiocarbamate | 2 | 97 | 1 |
| Vegetable oil with 1 wt. % naphthylamine | 2 | 100 | −2 |
| Vegetable oil with 1 wt. % phenylamine | 2 | 97 | 1 |
| High oleic sunflower oil with 0.5 wt. % amino type antioxidant | 2 | 98 | −0.5 |
| High oleic sunflower oil with 1.0 wt. % amino type antioxidant | 1.5 | 99 | −1 |
| High oleic sunflower oil with 0.5 wt. % amino type antioxidant | 0.5 | 102 | −3 |

TABLE 7

Comparison of Wear Properties of Oils
Four Ball Wear Test data: steel-on-steel, 40 kg load at 75° C., in air, 600 rpm

| # | LUBRICANT | RUN-IN (30 min.) [mm] | STEADY STATE I (+30 min.) [mm] | STEADY STATE II (+30 min.) [mm] |
|---|---|---|---|---|
| 1 | Sunflower Oil | 0.46 (0.16) | 0.51 (+0.05) | 0.55 (+0.04) |
| 2 | Mineral Oil Base 7628 | 0.54 (.24) | 0.64 (+0.10) | 0.72 (+0.06) |
| 3 | Sunflower Oil + 200 ppm Cu | 0.56 (0.26) scuffing | 0.57 (+0.01) | 0.58 (+0.01) |
| 4 | Sunflower Oil + 2000 ppm Cu | 0.67 (0.37) scuffing | 0.81 (+0.14) | 0.90 (+0.09) |
| 5 | Sunflower Oil + 1 vol. % ZDP | 0.36 (0.06) | 0.39 (+0.03) | 0.41 (+0.02) |
| 6 | Sunflower Oil + 200 ppm Cu + 1% ZDP | 0.34 (0.04) | 0.35 (+0.01) | 0.365 (+0.015) |
| 7 | Sunflower Oil + 2000 ppm Cu + 1% ZDP | 0.34 (0.04) | 0.35 (+0.01) | 0.36 (+0.01) |
| 8 | Sunflower Oil + 2000 ppm Cu + 0.5% LB-400 | 0.54 (0.24) scuffing | N/A | N/A |
| 9 | Sunflower Oil + 2000 ppm Cu + 2.% LB-400 | 0.41 (0.11) | 0.48 (+0.07) | 0.54 (+0.06) |
| 10 | Vegetable Motor Oil 10 W 30 | 0.34 (0.04) | 0.35 (+0.01) | 0.36 (+0.01) |
| 11 | SAE 10 W 30 | 0.37 (0.07) | 0.40 (+0.03) | 0.43 (+0.03) |
| 12 | Sunflower or Corn and Sunflower + 500–600 ppm Cu + 500 ppm Sb | .328 (0.028) | .339 (0.011) | .467 (0.128) |

ΔWear is shown in parentheses on this table.
ΔWear for "run in" is the difference between the final wear scar and the Hertz diameter which represents elastic conformance of the balls to the 40 kg load.
Wear for steady state wear is the difference in wear scar noted in the 30 min. steady state test.
Hertz diameter at 40 kg load with 52–100 steel balls is 0.30 mm.

TABLE 8

Extreme Pressure Properties of Some Natural Oil Based Lubricants

| LUBRICANT | SCUFFING LOAD, kg |
|---|---|
| Mineral Base Stock 7828 | 40 |
| Sunflower Oil | 50 |
| Corn Oil | 50 |
| Sunflower Oil + 2000 ppm Cu | 40 |
| Sunflower Oil + Cl add. + 5% K-2300 | <60 |
| Corn 10W30 for E-85 fuel | >110 |
| Sunflower 10W30 | 110 |
| Sunflower 10W30 + 2000 ppm Cu | >100 |
| Commercial SAE 10W30 | <80 |

TABLE 8-continued

Extreme Pressure Properties of Some Natural Oil Based Lubricants

| LUBRICANT | SCUFFING LOAD, kg |
|---|---|
| Sunflower or Corn and Sunflower oil blend + 500–600 ppm Cu + 500 ppm Sb, 1700 ppm of Zn from zinc dithiophosphate | 160 |

TABLE 9

| | Typical Properties of Formulated Oils | | | | | | | | | |
|---|---|---|---|---|---|---|---|---|---|---|
| | VISC @ | cSt @ | VISCOSITY | | Metal Content ppm | | | | | |
| OIL | 100° C. | 40° C. | INDEX | TBN* | Mg | Ca | Zn | P | Cu | Sb |
| Vegetabie Oil + Cu | 10.9 | 58.0 | 180 | 9.5 | 550 | 1700 | 1700 | 1550 | 2000 | 0 |
| Vegetable Oil + Cu + Sb | 9.8 | 49.0 | 170 | 8.0 | 440 | 1350 | 1350 | 1250 | 500 | 600 |
| Vegetabie Oil + Cu + Sb with less zinc dithio-phosphate | 9.8 | 49.0 | 170 | 8.0 | 440 | 1350 | 675 | 625 | 500 | 600 |
| Commercial (mineral) 10W-30 | 11.5 | 80 | 140 | 7.0 | 550 | 1400 | 1400 | 1300 | 0 | 0 |

*TNB is the neutralizing power of the medium. It is monitored to assure that the medium is not becoming acid. An acid medium may corrode metal components. N/A means the values are not available.

While in accordance with the patent statutes the best mode and preferred embodiment has been set forth, the scope of the invention is not limited thereto, but rather by the scope of the attached claims.

What is claimed is:

1. A lubricant composition comprising;

a) at least 20 volume percent of at least one vegetable oil triglyceride of the formula

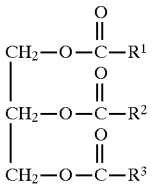

wherein $R^1$, $R^2$ and $R^3$ are independently, aliphatic hydrocarbyl groups of from 7 to 23 carbon atoms, said hydrocarbyl groups of said at least one triglyceride being at least about 20 mole % monounsaturated, and b) from about 50 to about 2000 ppm of copper based upon the weight of the lubricant composition, said copper being in an oil soluble form.

2. A lubricant composition according to claim 1, further comprising from about 100 to 2000 ppm of antimony, said antimony being in an oil soluble form.

3. A lubricant composition according to claim 1, wherein at least 60 mole % of the combined $R^1$, $R^2$, and $R^3$ of said at least one triglyceride are the alkene portion of oleic acid.

4. A lubricant composition according to claim 3, wherein said vegetable oil triglyceride includes an oil from a genetically modified plant comprising sunflower, safflower, corn, soybean, rapeseed, crambe lesquerella, peanut, cottonseed, canola, meadowfoam or combinations thereof.

5. A lubricant composition according to claim 1, wherein said copper is added in the form of a copper carboxylate.

6. A lubricant composition according to claim 5, wherein the majority of the carboxylate of said copper carboxylate is free of atoms other than carbon, oxygen and hydrogen.

7. A lubricant composition according to claim 1, wherein said vegetable oil triglyceride is from 50 to about 95 volume percent of said lubricant.

8. A lubricant composition according to claim 7, wherein said copper is present from about 50 to about 1200 ppm based upon the weight of said lubricant composition and said composition further includes from about 100 to about 2000 ppm of antimony, said antimony being in an oil soluble form.

9. A lubricant composition according to claim 8, wherein said antimony is added as antimony dialkyldithiocarbamate.

10. A lubricant composition according to claim 8, wherein said antimony is added as antimony dialkylphosphorodithioate.

11. A lubricant composition according to claim 9, further comprising from about 500 to about 2500 ppm of zinc, said zinc being in an oil soluble form and being added in the form of zinc dithiophosphate.

12. A lubricant composition according to claim 9, further comprising a tolutriazole compound.

13. A lubricant composition according to claim 8, wherein at least 60 mole % of the combined $R^1$, $R^2$ and $R^3$ of said at least one triglyceride are the alkene portion of oleic acid.

14. A lubricant composition according to claim 13, wherein said vegetable oil triglyceride includes an oil from a genetically engineered plant comprising sunflower, safflower, corn, soybean, rapeseed, canola, crambe, peanut, cottonseed, lesquerella, or meadowfoam or combinations thereof.

15. A lubricant composition according to claim 8, wherein at least 80 mole % of the combined $R^1$, $R^2$, and $R^3$ are the alkene portion of oleic acid.

16. A lubricant composition according to claim 8, wherein said oil soluble copper comprises copper ethylhexanoate, copper neodecanoate, copper stearate, copper propionate, copper naphthalate, or copper oleate or blends thereof.

17. A lubricant composition according to claim 5, wherein said copper is present from about 50 to about 1200 pm.

18. A lubricant composition according to claim 8, wherein said copper is present from about 100 to 800 ppm.

19. A lubricant composition according to claim 13, wherein said vegetable oil triglyceride is from about 40 to about 99 volume percent of said lubricant.

20. A lubricating oil composition being derived from blending in any order components comprising:

a) at least 20 volume percent of at least one vegetable oil triglyceride of the formula

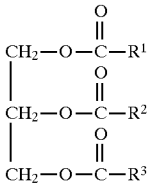

wherein $R^1$, $R^2$ and $R^3$ are independently, aliphatic hydrocarbyl groups of from 7 to 23 carbon atoms, said hydrocarbyl groups of said at least one triglyceride being at least about 20 mole % monounsaturated, and b) from about 50 to about 2000 ppm of copper based upon the weight of the lubricant composition, said copper being in an oil soluble form.

21. A lubricating oil composition according to claim 20, further including from about 100 to about 4000 ppm of antimony.

22. A lubricating oil composition according to claim 20, wherein said vegetable oil triglyceride is from about 40 to about 99 volume percent of said composition.

23. A lubricating oil composition according to claim 22, wherein at least 60 mole percent of the combined $R^1$, $R^2$, $R^3$ of said at least one triglyceride are oleic acid less the $CO_2H$.

24. A lubricating oil composition according to claim 23, further including from about 100 to about 4000 ppm of antimony in an oil soluble form.

* * * * *